US005403409A

United States Patent [19]

Tahara et al.

[11] Patent Number: 5,403,409

[45] Date of Patent: Apr. 4, 1995

[54] NITRIDED STAINLESS STEEL PRODUCTS

[75] Inventors: Masaaki Tahara; Haruo Senbokuya; Kenzo Kitano; Tadashi Hayashida, all of Osaka; Teruo Minato, Wakayama, all of Japan

[73] Assignee: Daidousanso Co., Ltd., Osaka, Japan

[21] Appl. No.: 40,616

[22] Filed: Mar. 31, 1993

[51] Int. Cl.[6] ..... C21D 1/06

[52] U.S. Cl. ..... 148/318

[58] Field of Search ..... 148/318, 230

[56] References Cited

U.S. PATENT DOCUMENTS

| | | | |
|---|---|---|---|
| 3,943,010 | 3/1976 | Hartline, III | 148/318 |
| 4,382,829 | 5/1993 | Kanero et al. | 148/318 |
| 4,975,147 | 12/1990 | Tahara et al. . | |
| 5,013,371 | 5/1991 | Tahara et al. . | |
| 5,112,030 | 5/1992 | Tahara et al. . | |
| 5,114,500 | 5/1992 | Tahara et al. . | |
| 5,141,567 | 8/1992 | Tahara et al. . | |
| 5,176,889 | 1/1993 | Yoshino et al. . | |
| 5,208,073 | 5/1993 | Yoshino . | |
| 5,252,145 | 10/1993 | Tahara et al. . | |
| 5,254,181 | 10/1993 | Yoshino et al. . | |

FOREIGN PATENT DOCUMENTS

| | | |
|---|---|---|
| 0408168 | 1/1991 | European Pat. Off. . |
| 0511409 | 11/1992 | European Pat. Off. . |
| 0515701 | 12/1992 | European Pat. Off. . |

OTHER PUBLICATIONS

European Search Report for EP 93 30 2930.8 dated Jun. 7, 1994.

*Primary Examiner*—Deborah Yee

*Attorney, Agent, or Firm*—Armstrong, Westerman, Hattori, McLeland & Naughton

[57] ABSTRACT

Nitrided stainless steel products having a base material of stainless steel containing austenitic stainless steel. At least a portion of the surface layer of the base material is composed of a nitrided hard layer in accordance with the following conditions (A) and (B):

(A) the nitrided hard layer substantially does not contain crystalline chromium nitride, and (B) the nitrided hard layer contains from 2 to 12% by weight N atoms.

3 Claims, 5 Drawing Sheets

NITRIDED STAINLESS STEEL PRODUCTS

FIELD OF THE INVENTION

This invention relates to nitrided stainless steel products superior both in anti-corrosion property and surface hardness.

BACKGROUND OF THE INVENTION

Generally, austenitic stainless steel products such as screws have been widely employed because of their superiority in not only corrosion resistance, but also toughness, workability, heat resistance and non-magnetic property and the like. However, although austenitic stainless steel products have excellent anti-corrosion property, as mentioned above, they do not have quenching hardenability so that they are not suitable for such usage as requires high surface hardness.

Among stainless steel materials, martensitic stainless steel containing chromium at 13 to 18% (by weight; the same applies hereinafter) have been also employed besides the above austenitic stainless steel. This martensitic stainless steel has quenching hardenability, however, it is inferior greatly in its corrosion resistance property to austenitic stainless steel. Therefore, this material cannot be applied to the such usage as requires corrosion resistance. On the other hand, from the viewpoint that the above austenitic stainless steel lacks surface hardness, hard chrome plating and the like has been applied in order to improve the deficiency. However, there is a problem practically in the above plating because the adhesive of plating coat is low thereto.

Recently, corrosion resistance of stainless steel has been focused on. It has been increasingly demanded to maintain this corrosion resistance and at the same time to improve its surface hardness. For this purpose, the inventors of the present invention have tried to apply nitriding treatment to austenitic stainless steel superior in corrosion resistance (18-8 stainless steel containing 18% chromium and 8% nickel has been widely employed) and to form a nitrided hard layer so as to improve its surface hardness.

As a method of nitriding treatment, a variety of methods such as salt bath nitriding treatment, ionitriding treatment, gas nitriding and the like are available. Nitriding temperature is usually set around 550° to 570 ° C., and around 480° at the lowest in these nitriding treatments. As results of nitriding screws made of austenitic stainless steel by such nitriding methods, in spite that the surface hardness has been improved, original property of corrosion resistance for stainless steel deteriorates so that a defect of easily rusting has been caused.

OBJECT OF THE INVENTION

Accordingly it is an object of the present invention to provide stainless steel products which have both of high anti-corrosion property and superior surface hardness.

DISCLOSURE OF THE INVENTION

For the above object, base material of stainless steel products for this invention comprises austenitic stainless steel wherein a portion of the surface layer at least is composed of a nitrided hard layer being in accord with the following (A) and (B):

(A) such a nitrided hard layer as substantially does not contain crystalline chrome nitrided.

(B) such a nitrided hard layer as contains N atoms at 2 to 12% in austenitic stainless steel phase of base phase.

The inventors has conducted a series of studies to pursue a cause of deteriorating corrosion resistance property by the above nitriding treatment. As a result, they found out that the above deterioration of corrosion resistance was caused because a crystalline chromium nitride (CrN) was produced by deposition in the formed nitrided layer and then the concentration of solid soluble chromium (Cr) in the basic phase (austenitic phase) sharply decreases, wherein active chromium indispensable to form a passive layer coat almost disappears, for the passive layer coat functions as retaining corrosion resistance property, original property for stainless steel. And as results of further accumulated researches, they reached the present invention by the following findings. When the above nitriding treatment for austenitic stainless steel was set considerably at a low temperature (in the lower range by 100° to 200° C. than prior nitriding temperature 480° to 580° C.), N atoms can penetrate the base phase ($\gamma$ phase) of austenitic stainless steel without depositing solid soluble chromium nitride (CrN) or iron nitride and then that corrosion resistance does not deteriorate by limiting the amount of the above penetration (volume of content) within 2 to 12%, and further a nitrided hard layer having superior surface hardness can be formed by the above penetration of N atoms. It is thought that the above N atoms only penetrate$\gamma$ phase in this case and the lattice is distorted thereby, however, deposition of crystalline chromium nitride and the like is not led. When the volume containing the above N atoms is over the above upper limitation, corrosion resistance property may deteriorate because crystalline chromium nitride may be produced by N atoms, which penetrate thereto, and chromium. Meanwhile, when it is below the above lower limitation, a nitrided hard layer having surface hardness cannot be adequately produced.

It is confirmed by an X-ray diffraction method that stainless steel products in the present invention does not contain crystalline chromium nitride as the above mentioned and that the amount of N atoms contained in the austenitic stainless steel phase can be identified by ESCA (Electron Spectroscopy for Chemical Analysis) or EPMA (Electron Probe Micro Analyzer). In this case, substantially "does not contain crystalline chromium nitride" means that the content is a very small amount (not more than 5%).

The present invention is now described in further detail.

Nitrided stainless steel products in the present invention can be obtained by nitriding austenitic stainless steel itself as a raw material, or nitriding an austenitic stainless steel product which is formed into a defined shape. As the above austenitic stainless steel materials, a variety of austenitic stainless steels varied in elements and ingredients can be available in accordance with the characteristic required such as corrosion resistance, processing hardenability, heat resistance, machinability, non-magnetic property and the like, based upon 18-8 austenitic stainless steel as mentioned above. In addition, Cr-Ni-Mo austenitic stainless steel containing not less than 22% chromium is contained, too. Still furthermore, austenitic stainless steel having chromium less than 22% but molybdenum not less than 1.5% is contained in the present invention.

The nitriding treatment for the above austenitic stainless steel or its formed products (these are called as stainless steel products) is performed in the following method. That is, prior to nitriding treatment, a fluoriding treatment is performed to promote the penetration of N atoms in the nitriding treatment. As fluoride-containing gases to fluoride, fluorine compound gases such as $NF_3$, $BF_3$, $CF_4$, HF, $SF_6$, $C_2F_6$, $CHF_3$, or $SiF_4$ are used independently or in combination. Besides, fluorine compound gas with F in its molecule can be used as the above-mentioned fluorine- or fluoride-containing gas. This fluorine- or fluoride-containing gas can be used independently, but generally is diluted by an inert gas such as $N_2$ gas for the treatment. The concentration of the fluorine- or fluoride-containing gas itself in such a diluted gas should amount to, for example, 10,000 to 100,000 ppm, preferably 20,000 to 70,000 ppm, more preferably 30,000 to 50,000 ppm. In the light of practicability, $NF_3$ is the best among the above compound gases. This is because $NF_3$ has chemical stability and is easy to treat since it is in a state of a gas at normal temperature.

First of all, a fluorine- or fluoride-containing gas atmosphere is prepared at the above-mentioned concentration, wherein the above stainless steel product is held in a heated condition. In this case, the stainless steel product itself is heated up to the temperature of 300° to 550°. The holding time of the above-mentioned stainless steel product in a fluorine- or fluoride-containing gas atmosphere may appropriately be selected depending on geometry, dimension and the like, generally within the range of ten or so minutes or scores of minutes. Such a fluoriding treatment allows "N" atoms to penetrate into the surface layer of stainless steel products. Though its mechanism has not been proven at present yet, it can be understood as follows on the whole. That is, a passive layer coat is formed, which inhibits penetration or diffusion of N atoms as a function of nitriding, on the surface of the above stainless steel product. Therefore, according to the prior method, N atoms could not penetrate thereto due to the presence of passive layer coat (oxidized layer) unless the temperature for nitriding treatment is set at high temperature. As a result, crystalline chromium nitride was deposited in the surface hard layer. However, a fluoriding treatment is performed under fluorine- or fluoride- containing gas atmosphere prior to the nitriding treatment in the present invention. Upon holding the stainless steel product having an oxidized layer in a fluorine- or fluoride-containing gas atmosphere like the above with heating, the passive coat layer is converted to a fluorinated layer. Since "N" atoms for nitrization penetrate more readily into the fluorinated layer than into the passive coat layer, the surface of the above stainless steel product is formed on the suitable condition for penetration of "N" atoms by the above-mentioned fluorination. Thus, it is considered that "N" atoms in the nitriding gas penetrate uniformly into the surface of the stainless steel product to a certain depth when the stainless steel product is held in a nitriding atmosphere with suitable surface condition to absorb "N" atoms, shown below, resulting in the formation of a deep uniform nitrided layer.

Thus, the stainless steel product with suitable surface condition to absorb "N" atoms by fluorination is held with heating in a nitriding atmosphere so as to nitride. In this case, the nitriding gas composing the nitriding atmosphere is a simple gas composed of $NH_3$ only, or a mixed gas (for example, $NH_3$, CO and $CO_2$) composed of carbon source gas (for example, RX gas) with a mixed gas composed of $NH_3$. Generally, the above-mentioned simple gas or gas mixture is used by mixing an inert gas such as $N_2$. According to the case, $H_2$ gas is further added to those gases. In such a nitriding atmosphere, the above-mentioned fluorinated stainless steel product is held with heating. In this case, a heating condition is set at a temperature not more than 450° C., which is greatly lower than that in-the prior method. Especially, the preferable temperature is between 370° and 420° C. When the above temperature is over 450° C. crystalline CrN is formed in a nitrided hard layer and the concentration of active chromium in the base phase decreases, and then as a result the anti-corrosion property of stainless steel deteriorates. Furthermore, a nitriding treatment at not more than 420° is preferable because superior anti-corrosion property is realized to same degree as that of austenitic stainless steel itself and also, a nitrided hard layer greatly superior in hardness can be formed on the surface of stainless steel products. On the other hand, nitriding treatment at not more than 370° C. only realizes a nitrided hard layer not more than 10 μm in depth, even if nitriding treatment time is set at 24 hours, which is of little industrial value and not practical. Generally, the above nitriding treatment time is set within the range of 10 to 20 hours.

By this nitrided treatment, a close nitriding layer of about 20 to 40 μm, (consisting of entirely single layer) is formed uniformly on the surface of the above-mentioned stainless steel product. According to the above nitriding treatment, dimensional change and surface roughness are hardly caused on the austenitic stainless steel products. That is, in the prior method, the frame of a stainless steel product may be expanded and then dimensional change may be caused due to deposition of crystalline chromium nitride and the like, and also surface roughness may be deteriorated so that it requires a great amount of cost for final finishing, and furthermore, it is difficult for the technique to be applied to precision machines. On the other hand, the nitrided hard layer in the present invention does not contain crystalline chromium nitride and is composed of close organization, so that dimensional change or deterioration of surface roughness may not be caused and as a result, it does not require the final processing for finishing.

The crystalline chromium nitride is not contained in this nitrided hard layer while "N" atoms are contained in austenitic phase of base phase (γ phase) at the rate of 2 to 12%. Therefore, the stainless steel products in which the nitriding treatment is given (that is to say, the nitrided stainless steel products) has corrosion resistance property as high as the austenitic stainless steel in which the nitriding treatment is not given and furthermore, the surface hardness is greatly improved thanks to the presence of the above nitrided hard layer. The more superior the corrosion resistance property of such nitrided stainless steel products is, the lower the processing hardness is or the more precisely the surface condition before being nitrided is polished. In addition, from the viewpoint of materials, the more chromium is contained thereto such as SUS310 (chrome:25%, nickel:20%), the better corrosion resistance is. Furthermore, regarding 18-8 austenitic stainless steel materials, the more molybdenum is contained thereto, the better it is. The nitrided stainless steel products obtained in the above method have corrosion resistance property as same as the austenitic stainless steel before being nitrided, besides the surface hardness is greatly improved and still moreover it becomes non-magnetic. Namely, according to the conventional nitriding method, the non-magnetic property is deteriorated, which originally belongs to austenitic stainless steel itself, by deposition of crystalline chromium nitride and then the nitrided hard layer takes on the character of magnetic property. Meanwhile, since the nitrided hard layer in the present invention does not contain crystalline chromium nitride, the non-magnetic property is maintained. Therefore, it is suitable for the usage which requires non-magnetic property such as products in relation to computer.

Furthermore, it is possible that treatment by strong mixed acid containing $HNO_3$ is performed on the above stainless steel products after being nitrided. The oxidized scale attached to the surface of stainless steel products after being nitrided can be removed by this treatment, and at the same time, according to the case, a passive layer (an oxidized layer), caused by the solid soluble chromium, can be formed thickly at the early stage on the surface of the stainless steel products thanks to the function of nitric acid, so that the oxidized layer can be strengthened. In detail, according to the case, an oxidized layer may be caused on the surface of nitrided stainless steel products by the above nitriding treatment. Since this oxidized scale is likely to cause rust, the corrosion resistance of the nitrided hard layer deteriorates due to the presence of the oxidized scale. Therefore, the oxidized layer can be removed by the above strong mixed acid treatment and prevents the corrosion resistance property from deteriorating. In addition, the corrosion resistance property of austenitic stainless steel is caused by the production of a passive layer (an oxidized layer) based upon the solid solution chromium in the base phase.

The passive layer is produced at the early stage and also strengthened by the above strong mixed acid treatment so that the improvement of corrosion resistance can be seen. As such strong mixed acids, mixed acid composed of $HNO_3$-HF or mixed acid containing $HNO_3$ such as $HNO_3$-HCl can be applied. The concentration of $HNO_3$ of these strong mixed acid should be set at 10 to 20%, 1 to 10% for HF, and 5 to 25% for HCl. Water accounts for the remaining part of strong mixed acid. The above treatment should be performed by dipping the stainless steel products in the above strong mixed acid liquid for 20 to 60 minutes with controlling the liquid temperature of strong mixed acid within 20° to 50° C. Although the top surface layer occupying 20 to 30% of total nitrided layer is removed by such a strong mixed acid treatment, the surface hardness of remaining parts is still high, wherein the adequate rigidity is maintained. In this case, the nitrided hard layer remaining becomes a complete non-magnetic substance by removing the top surface phase. Even though the nitrided hard layer of the top surface layer may have slight magnetic property according to the case, stainless steel products come to show magnetic permeability as same as austenitic stainless steel (base material) because the top surface layer having magnetic property can be removed by the above strong mixed acid treatment. In addition, since the volume of N atoms penetrating into the above top surface layer is great, the above top surface layer may rust more or less compared with the other parts. However, the internal layer, wherein N atoms is relatively few (N atoms:2 to 7% by weight or even 2 to 5 %), appears to the outside by removing the top surface layer. This layer has adequate hardness, which is only slightly lower than the above top surface layer, and furthermore, has less rusting characteristic. Therefore, it is suitable for such usage as requires sufficient hardness and complete anti-rust property.

Figure 1:
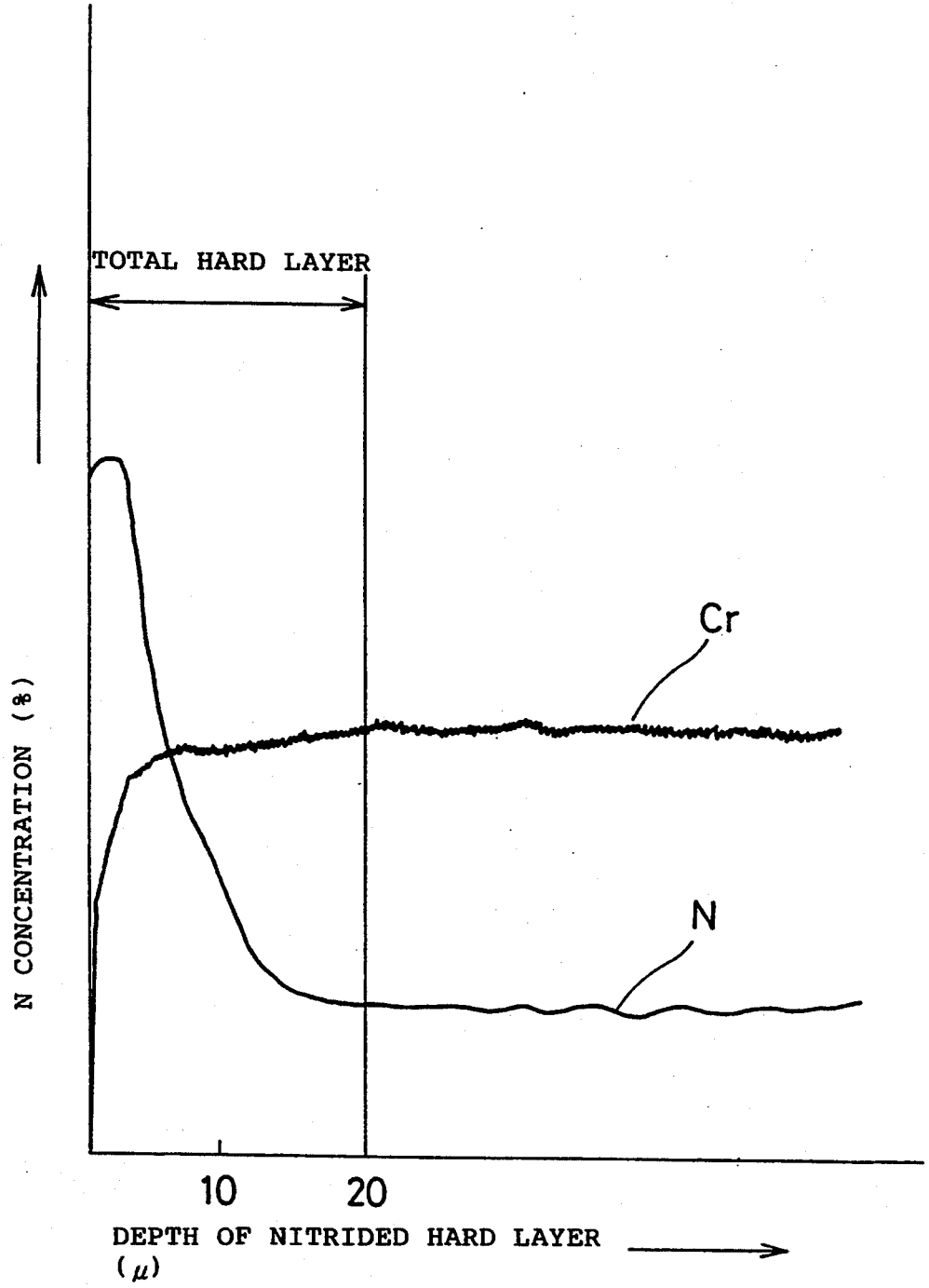
FIG. 1 shows an EPMA analysis curve chart for samples of EXAMPLES.

The following examples and comparative examples are further illustrative of the invention.

EXAMPLE 1

Three kinds of samples (finished by polishing), SUS304 plate (Chromium:18%, Nickel:8%), SUS316 plate (Chromium:18%, Nickel:12%, Molybdenum:2%, Core hardness: Hv=310) and SUS310 plate (Chromium:25%, Nickel:20%, Core hardness: HV=370) were prepared. Next, these samples were charged into a muffle furnace, the inside of the furnace was vacuum purged and raised to 410° C. Then, maintaining the state, fluoride-containing gas ($NF_3$10 vol %+$N_2$ 90 vol %) was charged into the muffle furnace to form an atmospheric pressure therein and such a condition was maintained for 15 minutes for fluoriding. Then after exhausting the above-mentioned fluoride-containing gas out of the furnace, nitriding gas ($NH_3$ 25 vol %+$N_2$ 60 vol % +CO 5 vol %+$CO_2$ 5 vol %) was introduced into the furnace and the inside of the furnace was maintained at 410° C. for 24 hours for nitriding and was withdrawn.

Each surface hardness of the above samples (SUS304 plate, SUS316 plate and SUS310 plate) nitrided in this way was measured. SUS304 plate hardening was Hv of 880, SUS316 plate hardening was Hv of 1050 and SUS310 plate was Hv of 1120. In addition, as for each thickness of the hard layer SUS304 plate was 18μ, SUS316 plate was 20μ and SUS310 plate was 18μ.

EXAMPLE 2

The temperature for nitriding of EXAMPLE 1 was changed to 440° C. and the treatment time was changed to 12 hours. The other conditions were the same as EXAMPLE 1. As results of the same, measurements for the nitrided products obtained, each surface hardness for all three was not less than Hv of 1100 and each thickness was 23 μm for SUS304 plate, 25 μm for SUS316 plate and 20 μm for SUS310 plate respectively.

EXAMPLE 3

The temperature for nitriding of EXAMPLE 1 was changed to 380° C. and the treatment time was changed to 15 hours. The other conditions were the same as EXAMPLE 1. As results of the same measurements for the nitrided products were obtained, each surface hardness for all three was not less than Hv of 950 and the each thickness was 15 μm for SUS304 plate, 15 μm for SUS316 plate and 12 μm for SUS310 plate respectively.

COMPARATIVE EXAMPLE 1

Three kinds of the same plates as used in EXAMPLE 1 were applied here. Each plate was fluorided at 400° C. and then charged into the same muffle as used in EXAMPLE 1 by using the same gas for nitriding as EXAMPLE 1, and then was nitrided at 550° C. for 5 hours and finally withdrawn. Each surface hardness was Hv of 1280, Hv of 1280 and Hv of 1300 respectively in order, meanwhile each thickness of hard layer was 30 to 35 μm. Next, samples obtained by the above EXAMPLE 1 to 3 were dipped into strong mixed acid liquid containing 5% HF-18% $HNO_3$ for 60 minutes and then withdrawn for checking. The top surface layer (3 to 6 μm) in the nitrided hard layer of each sample was removed. In addition, as for COMPARATIVE EXAMPLE 1, the same treatment was performed. As a result, a total nitrided hard layer was removed.

Subsequently, surface hardness and content of N atoms in the top surface of nitrided hard layer for each sample obtained from the above EXAMPLE 1 to 3, COMPARATIVE EXAMPLE 1 and those treated by strong mixed acid liquid were worked out. The results are shown in the following Table 1. In the Table 1, "with acid treatment" means that acid treatment was conducted on samples, while "without acid treatment" means that samples are in the step where the nitriding treatment has finished. In addition, content of N atoms was reckoned by a chart of the results from EPMA analysis done for the each above sample. As regards to corrosion resistance property, time required for rusting was obtained by the results from salt spray tests in accordance with JIS2371 (SST examination).

In addition, whether there is any presence of crystalline chromium was judged from the results of X ray diffraction method for each sample.

TABLE 1

| | | | SUS316 (CORE HARDNESS: Hv 310) | | | |
|---|---|---|---|---|---|---|
| | NITRIDING TEMP. (°C.) | ACID TREATMENT | SURFACE HARDNESS (Hv) | N CONTENT (WEIGHT %) | CRYSTALLINE CHROME | ANTI-CORROSION (SST) |
| EXAMPLE 1 | 410 | WITHOUT | 1050 | 7.6 | NONE | NOT LESS THAN 1800h |
| | | WITH | 820 | 2.8 | NONE | AS SAME AS THE ABOVE |
| EXAMPLE 2 | 440 | WITHOUT | 1180 | 9.0 | NONE | 48h |
| | | WITH | 860 | 5.8 | NONE | NOT LESS THAN 1800h |
| EXAMPLE 3 | 380 | WITHOUT | 970 | 3.7 | NONE | AS SAME AS THE ABOVE |
| | | WITH | 680 | 1.8 | NONE | AS SAME AS THE ABOBE |
| COMPARATIVE EXAMPLE 1 | 550 | WITHOUT | 1280 | 12.8 | EXIST | 2h |
| | | WITH | 330 | NOT MORE THAN 0.5 | NONE | NOT LESS THAN 1800h |
| | | | SUS310 (CORE HARDNESS: Hv 370) | | | |
| | NITRIDING TEMP. (°C.) | ACID TREATMENT | SURFACE HARDNESS (Hv) | N CONTENT (WEIGHT %) | CRYSTALLINE CHROME | ANTI-CORROSION (SST) |
| EXAMPLE 1 | 410 | WITHOUT | 1120 | 10.5 | NONE | NOT LESS THAN 1800h |
| | | WITH | 930 | 5.3 | NONE | AS SAME AS THE ABOVE |
| EXAMPLE 2 | 440 | WITHOUT | 1210 | 11.8 | NONE | NOT LESS THAN 48h |
| | | WITH | 920 | 7.0 | NONE | NOT LESS THAN 1800h |
| EXAMPLE 3 | 380 | WITHOUT | 960 | 5.9 | NONE | AS SAME AS THE ABOVE |
| | | WITH | 680 | 3.2 | NONE | AS SAME AS THE ABOVE |
| COMPARATIVE EXAMPLE 1 | 550 | WITHOUT | 1300 | 15.6 | EXIST | 2h |
| | | WITH | 390 | 0.5 | NONE | NOT LESS THAN 1800h |
| | | | SUS304 (CORE HARDNESS: Hv 180) | | | |
| | NITRIDING TEMP. (°C.) | ACID TREATMENT | SURFACE HARDNESS (Hv) | N CONTENT (WEIGHT %) | CRYSTALLINE CHROME | ANTI-CORROSION (SST) |
| EXAMPLE 1 | 410 | WITHOUT | 1020 | 7.4 | NONE | NOT LESS THAN 1800h |
| | | WITH | 650 | 2.5 | NONE | AS SAME AS THE ABOVE |
| EXAMPLE 2 | 440 | WITHOUT | 1020 | 8.5 | NONE | 48h |
| | | WITH | 720 | 4.6 | NONE | NOT LESS THAN 1800h |
| EXAMPLE 3 | 380 | WITHOUT | 980 | 3.5 | NONE | AS SAME AS THE ABOVE |
| | | WITH | 600 | 1.8 | NONE | AS SAME AS THE ABOVE |
| COMPARATIVE EXAMPLE 1 | 550 | WITHOUT | 1240 | 12.6 | EXIST | 2h |
| | | WITH | 180 | NOT MORE THAN 0.5 | NONE | NOT LESS THAN 1800h |

The following are findings from the above table. (1) As clear from comparison of SUS310 of EXAMPLE 2 with acid treatment and SUS316 of COMPARATIVE EXAMPLE 1 without acid treatment, on condition that there is no crystalline chromium nitride in the nitrided hard layer and at the same time concentration of N atoms is limited within 12%, corrosion resistance property can be materialized in the state practically acceptable. Bordering on 12%, however, when it is over 12%, deposition of crystalline chromium nitride can become seen and as a result corrosion resistance was greatly deteriorated. Conversely, as clear from SUS316 of EXAMPLE 3 with acid treatment, if the concentration of N atoms is lower than 2%, surface hardness usually shows not more than Hv of 700, which is not sufficient as surface rigidity. (2) As clear from the comparison among EXAMPLE 1 to 3, and COMPARATIVE EXAMPLE 1, the higher the nitriding temperature is, the more concentration (content) of N atoms in the nitrided hard layer is. (3) When strong mixed acid treatment is conducted, the top surface (wherein the concentration of N atoms is the greatest) of a nitrided hard layer is dissolved and then removed so that the next internal layer appears, which means a decrease in both concentration of N atoms and surface hardness. (4) From the viewpoint that concentration of N atoms in nitrided hard layer of SU310 is higher than that of SUS316, concentration of N atoms becomes higher in proportion to the concentration of Cr in base material. (5) Since crystalline chromium nitride is deposited over the whole nitrided hard layer, the sample of COMPARATIVE EXAMPLE lacks corrosion resistance. Therefore, the whole of a hard nitrided layer, which lacks corrosion resistance, disappears and a base material part is revealed.

Figure 2:
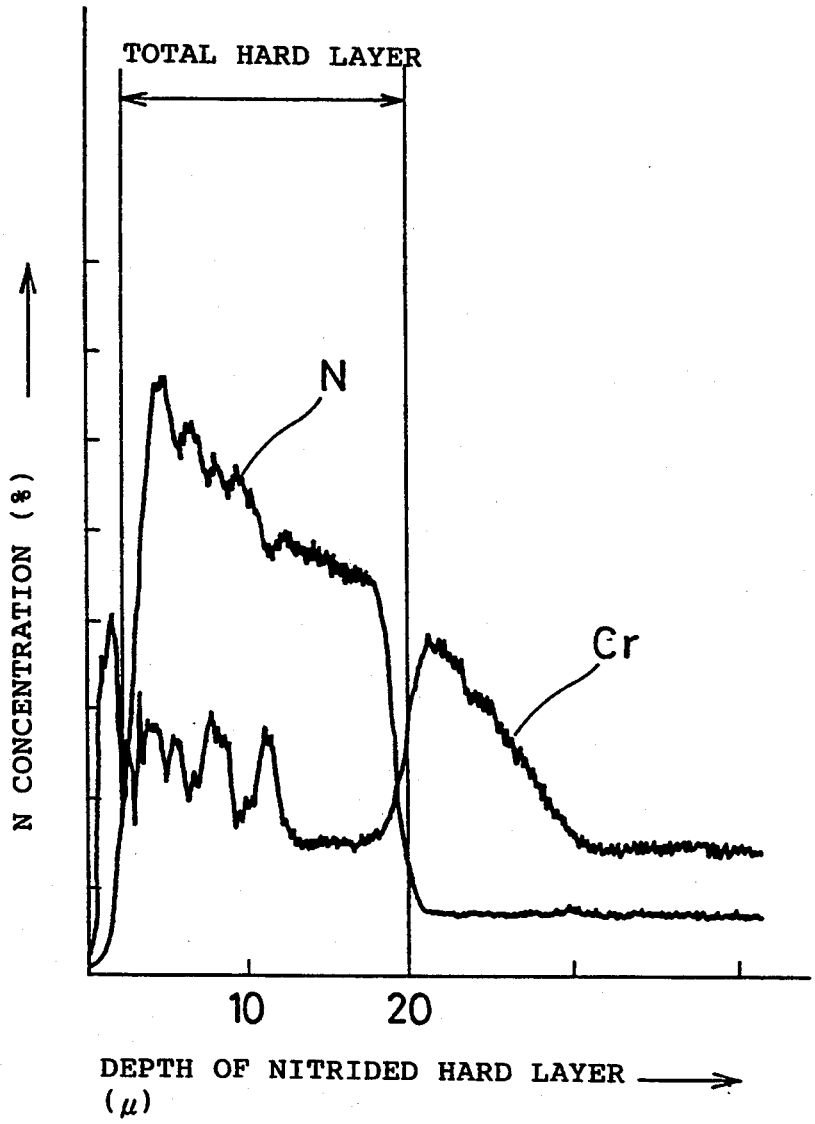
FIG. 2 shows an EPMA analysis curve chart for samples of COMPARATIVE EXAMPLES.

Besides, the results of the above EPMA analysis are shown in FIG. 1 (EXAMPLE 1) and FIG. 2 (COMPARATIVE EXAMPLE 2) taking EXAMPLE 1 (SUS316 without acid treatment) and COMPARATIVE EXAMPLE 1 (SUS316 without acid treatment) as representatives. As clear from the curves of N atom concentration in FIG. 1 and FIG. 2, N atom concentration (content) in the top surface of the nitrided hard layer in EXAMPLE 1 (SUS316) is 7.6% by weight, meanwhile that in COMPARATIVE EXAMPLE 1 (SUS316) is 12.8% by weight, which is remarkably high. The concentration of N atoms in the above EPMA is measured by a basic measurement line.

Figure 3:
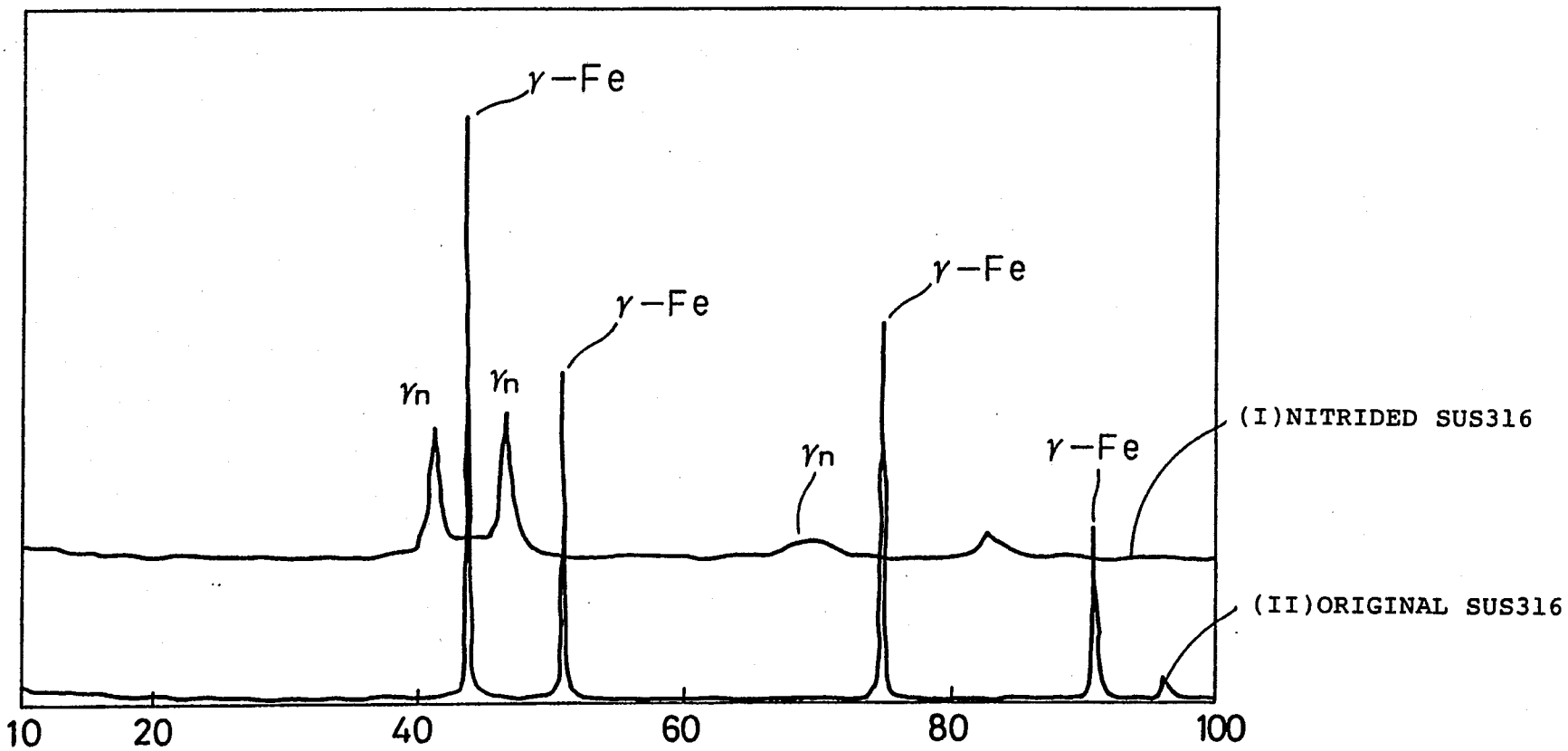
FIG. 3 shows an X ray diffraction curve for samples of EXAMPLES.
Figure 4:
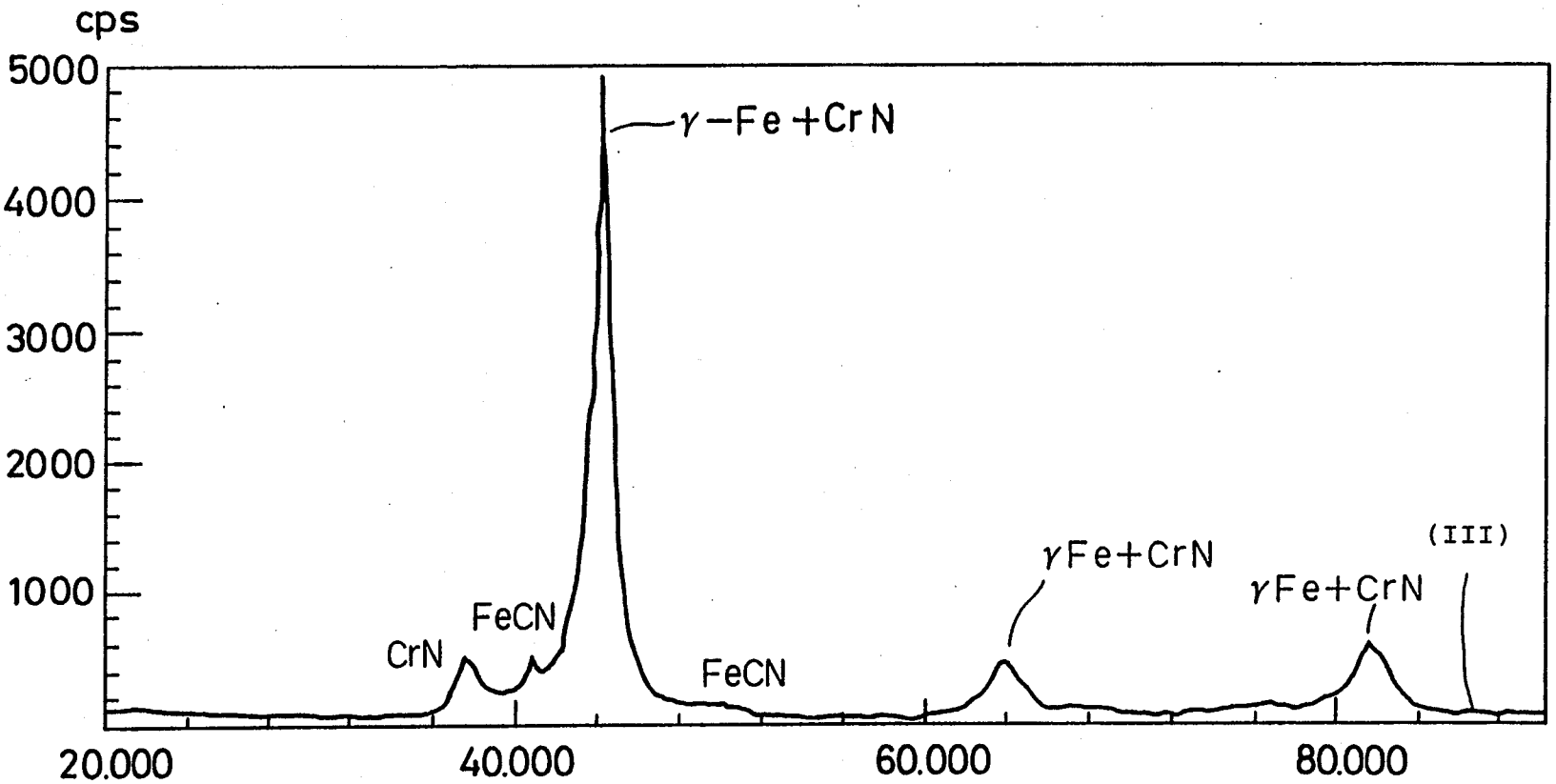
FIG. 4 shows an X ray diffraction curve for samples of COMPARATIVE EXAMPLES.

Furthermore, the results of X-ray diffraction method for the above EXAMPLE 1 and the COMPARATIVE EXAMPLE 1 (both are SUS316 without acid treatment) were shown in FIG. 3 (EXAMPLE 1) and FIG. 4 (COMPARATIVE EXAMPLE 1) as representative. In these figures, curve (I) represents an X-ray diffraction method of EXAMPLE 1, curve (II) an X-ray diffraction method of SUS316 (SUS316 materials without nitriding treatment) and curve (III) an X-ray diffraction method of COMPARATIVE EXAMPLE 1. In FIG. 3, $\gamma n$ represents $\gamma$ phase (base phase) containing N atoms by nitriding. In comparison of curve (I) and (II), $\gamma n$ phase (base phase) of curve (I) is slipped against the left side (low angle side) of $\gamma$-Fe phase (base phase) of corresponding curve (II), wherein lattice is distorted by an increase of lattice constant, so that surface hardness in samples of EXAMPLES can be improved. On the other hand, in curve (III) of COMPARATIVE EXAMPLES, plenty of crystalline chrome nitride peaks such as CrN can be seen, which decreases corrosion resistance of this nitrided layer.

Figure 5:
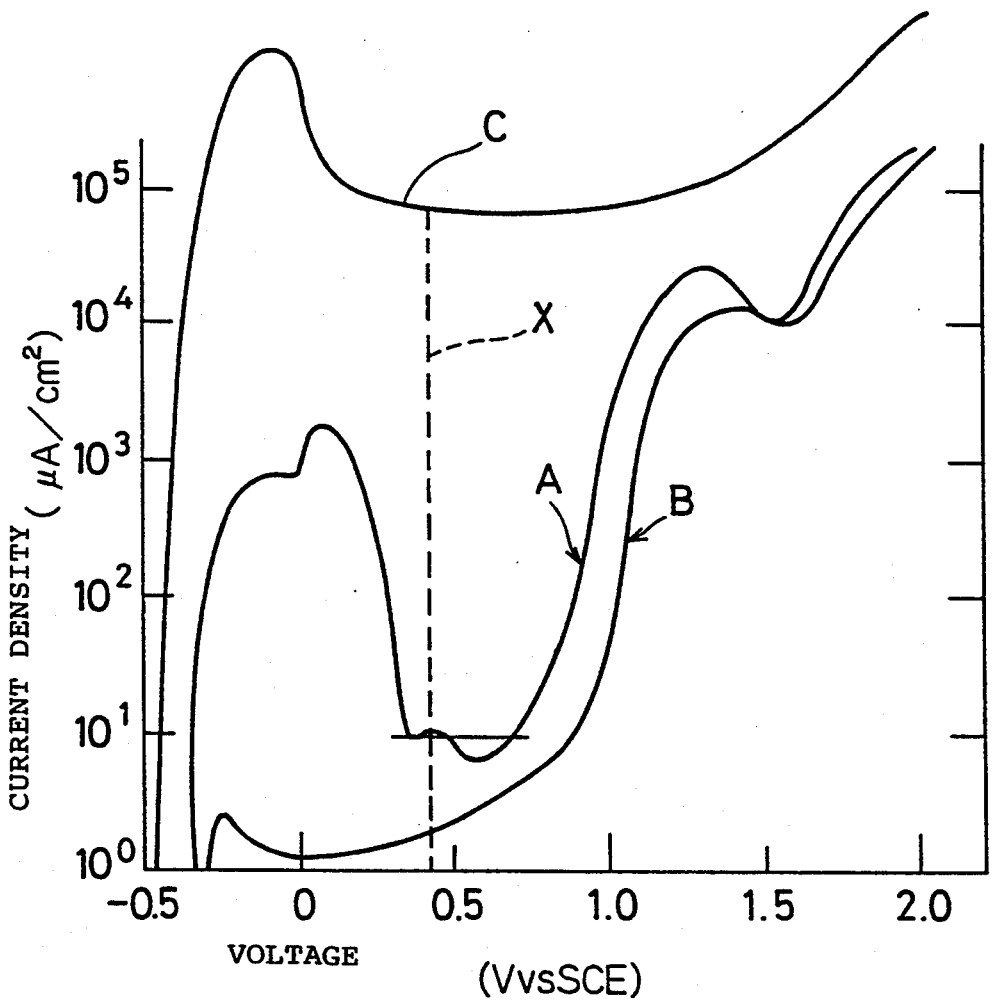
FIG. 5 shows a curve of current density and voltage curve.

Still furthermore, to check corrosion resistance electrochemically, each sample of EXAMPLE 1 and COMPARATIVE EXAMPLE 1 (each of them is SUS316 without acid treatment) obtained in the above method was given anodic polarization test (in accordance with JIS G 0579). The results are shown in FIG. 5. Checking the current electric level in the vicinity of a passive range (a broken line X), it is found out that EXAMPLE 1 (curve A) does not deteriorate so much compared with SUS316 base material (curve B) in which nitriding treatment was not conducted. On the other hand, it is found out that difference between COMPARATIVE EXAMPLE 1 (curve C) and SUS316 base material (curve B) is not less than a number of three figures, which means that the corrosion resistance has greatly deteriorated due to nitriding treatment.

EXAMPLE 4

Socket screws (M6) formed by cold forging from each wire rod made of SUS304 (chromium:18%, nickel:9%), SUS316 (Chromium:18%, nickel:12%, molybdenum:2.5%), SUS310 (chromium:25%, nickel:20%) and a hardened SUS309 material (chromium:22%, nickel:12%) by work hardening were subjected to fluoriding and nitriding treatment under the same procedure and conditions as same as EXAMPLE 1. The surface hardness of the nitrided samples was Hv of 1100 to 1150 and the depth of the whole nitrided hard layer was 18 to 20 μm. Next, these were subjected to shot blasting so as to remove the oxidized scale attached thereon and then subjected to SST examination. Each rusted within 72 hours.

Next, these samples were dipped into strong mixed acid liquid of 20% HCl-13% $HNO_3$ at the temperature of 45° C. for 60 minutes. Measuring the hardness, the surface hardness of samples are Hv of 850 to 900, while each thickness of hard nitrided layer was reduced by strong mixed acid by 5 to 8 μm to 12 to 15 μm. And then, the above samples after acid treatment were subjected to SST examination. As a result, corrosion resistance was improved and each of them did not rust at all over 1800 hours.

EXAMPLE 5

Non-magnetic stainless steel bar (chrome:18%, nickel: 12%, Mn:1.5%), to which a small amount of N atoms were added by steel-making process, and SUS316 bar were fluorided and nitrided in the same procedure and conditions as EXAMPLE 1. Next, nitrided articles obtained were dipped into strong mixed acid liquid of 10% HF-15% $HNO_3$ at the temperature of 40° C. for 30 minutes and finally withdrawn.

Next, the magnetic permeability (μ) of each of these samples was measured. It is found out that each of them does not have magnetism by the nitriding treatment as follows:

| | Non-magnetic stainless bar | | SUS316 bar | |
|---|---|---|---|---|
| | magnetic permeability (μ) | surface hardness (Hv) | magnetic permeability (μ) | surface hardness (Hv) |
| before nitriding | 1.001 | 480 | 1.002 | 240 |
| after nitriding | 1.015 | 1210 | 1.050 | 1120 |

-continued

| | Non-magnetic stainless bar | | SUS316 bar | |
|---|---|---|---|---|
| | magnetic permeability (μ) | surface hardness (Hv) | magnetic permeability (μ) | surface hardness (Hv) |
| after acid cleaning | 1.001 | 990 | 1.002 | 920 |

EFFECT OF THE INVENTION

As aforementioned, since nitrided stainless steel products in the present invention does not contain crystalline chromium nitride in the nitrided hard layer forming the surface layer, solid soluble chromium in austenitic stainless steel (base phase) is not consumed by deposition of crystalline chromium nitride, compared with nitrided stainless steel products containing crystalline chromium nitride in its nitrided hard layer. Therefore, passive layer coat (oxidized coat), which is formed by the function of crystalline chromium in the base phase, can be produced enough, so that it becomes to have excellent corrosion property as same as that of the above base phase. In addition, since rough crystalline chromium nitride is not produced in the nitrided hard layer by deposition, dimensional change or surface roughness of nitrided stainless steel products is not deteriorated by deposition of crystalline chromium nitride. As a result, there is no need to perform a final finishing process after nitriding treatment. And then, stainless steel products in the present invention can have the same excellent hardness as those formed by nitrided hard layer made of crystalline chromium nitride because said stainless steel products contain N atoms at 2 to 12% in the base phase of the surface layer, which has penetrated thereto.

What is claimed is:

1. Nitrided stainless steel products comprising a base material containing austenitic stainless steel, wherein a portion of the surface layer of said base material at least is composed of a nitrided hard layer having a hardness of at least 700 Hv and in accordance with the following conditions (A) and (B):

(A) said nitrided hard layer substantially does not contain crystalline chromium nitride; and (B) said nitrided hard layer contains from 2 to 7% N atoms by weight.

2. Stainless steel products according to claim 1 wherein said austenitic stainless steel contains chromium at not less than 22% by weight.

3. Stainless steel products according to claim 1 or 2 wherein said austenitic stainless steel contains molybdenum at not less than 1.5% by weight.

* * * * *

UNITED STATES PATENT AND TRADEMARK OFFICE
CERTIFICATE OF CORRECTION

PATENT NO.: 5,403,409
DATED : April 4, 1995
INVENTOR(S): TAHARA et al.

It is certified that error appears in the above-identified patent and that said Letters Patent is hereby corrected as shown below:

On the cover page, after Item [22], please add Item --
[30] Foreign Application Priority Data
March 1, 1993 [JP] Japan ..... 5-040234 --.

Signed and Sealed this

Eleventh Day of July, 1995

*Attest:*

*Attesting Officer*

BRUCE LEHMAN

*Commissioner of Patents and Trademarks*